US009750968B2

(12) United States Patent
Heimann et al.

(10) Patent No.: US 9,750,968 B2
(45) Date of Patent: Sep. 5, 2017

(54) EXERCISING IMPLEMENTS AND METHODS OF USE FOR PERFORMING MUSCULAR STRETCHING EXERCISES, RESPIRATION EXERCISES, AND RESISTANCE TRAINING

(71) Applicant: SDAYETPG LLC, Columbus, IN (US)

(72) Inventors: Andrew Heimann, Miami Beach, FL (US); David Rezac, Westborough, MA (US); Jeffrey Cerier, Franklin, MA (US); Amos Cruz, Wrentham, MA (US); Jonathan O'Keefe, North Attleboro, MA (US); Nicholas Trepkowski, San Diego, CA (US)

(73) Assignee: SDAYETPG LLC, Columbus, IN (US)

( * ) Notice: Subject to any disclaimer, the term of this patent is extended or adjusted under 35 U.S.C. 154(b) by 0 days.

(21) Appl. No.: 15/132,587

(22) Filed: Apr. 19, 2016

(65) Prior Publication Data

US 2016/0302988 A1 Oct. 20, 2016

Related U.S. Application Data

(60) Provisional application No. 62/150,040, filed on Apr. 20, 2015.

(51) Int. Cl.

| | |
|---|---|
| ***A63B 21/00*** | (2006.01) |
| ***A63B 21/002*** | (2006.01) |
| ***A63B 22/20*** | (2006.01) |

(52) U.S. Cl.

CPC ..... *A63B 21/0023* (2013.01); *A63B 21/4029* (2015.10); *A63B 22/203* (2013.01); *A63B 2210/50* (2013.01); *A63B 2225/09* (2013.01)

(58) Field of Classification Search

CPC . A63B 21/4029–21/4031; A61G 7/015; A61G 13/08; A61G 7/002; A61G 7/005; A61G 7/008; A61G 7/012; A61G 7/018; A61G 7/084; A61G 7/1086; A61G 7/1088; A61G 7/1092; A61G 7/1094; A61G 7/1096; A61G 7/1098; A61G 7/065; A61G 7/07; A61G 7/075; A61G 7/0755;

(Continued)

(56) References Cited

U.S. PATENT DOCUMENTS 137,596 A * 4/1873 Clinton ..... A61G 7/015 5/604
6,821,288 B2 * 11/2004 Schaeffer ..... A61H 1/0292 128/845

(Continued)

FOREIGN PATENT DOCUMENTS

EP 0999880 B1 4/2003

*Primary Examiner* — Sundhara Ganesan
*Assistant Examiner* — Jennifer M Deichl
(74) *Attorney, Agent, or Firm* — Roberts IP Law; John Roberts

(57) ABSTRACT

Provided is an articulating bench configured to support a user, comprising a longitudinally-extending frame structure pivotably supporting back-supporting and independently-pivotable leg supporting portions. Removable arm supporting portions may be provided that pivot about the back supporting portion. In various example embodiments the articulating bench structure may be foldable for compact storage. Various adjustment mechanisms and methods of use are disclosed.

4 Claims, 11 Drawing Sheets

(58) Field of Classification Search
CPC .... A61G 2013/0045; A61G 2013/0054; A61G 2013/0063; A61H 1/00–1/005; A61H 1/02; A61H 37/00; A47C 19/04; A47C 19/12; A47C 19/122; A47C 19/124; A47C 19/126; A47C 19/128; A47C 1/03; A47C 17/12; A47C 7/54–7/546; A47C 7/36–7/48; A47C 7/50–7/52
USPC .... 297/354.13, 362.12, 313, 423.26, 411.38, 297/411.39
See application file for complete search history.

(56) References Cited

U.S. PATENT DOCUMENTS

| | | | | |
|---|---|---|---|---|
| 2006/0123546 | A1* | 6/2006 | Horton | A61G 13/08 5/613 |
| 2006/0185091 | A1* | 8/2006 | Jackson | A61G 7/001 5/621 |

* cited by examiner

EXERCISING IMPLEMENTS AND METHODS OF USE FOR PERFORMING MUSCULAR STRETCHING EXERCISES, RESPIRATION EXERCISES, AND RESISTANCE TRAINING

CROSS-REFERENCE TO RELATED APPLICATIONS

The present application claims priority to, incorporates herein by reference, and is a non-provisional of U.S. provisional patent application Ser. No. 62/150,040 filed Apr. 20, 2015 and entitled Exercising Implements and Methods of Use for Performing Muscular Stretching Exercises, Respiration Exercises, and Resistance Training (herein, "the '040 application").

FEDERALLY SPONSORED RESEARCH OR DEVELOPMENT

None.

TECHNICAL FIELD

The present invention relates generally to exercising implements and methods of use for performing muscular stretching exercises, respiration exercises, and resistance training, including in certain example embodiments articulating benches configured to support a user.

BACKGROUND

Benches configured to support a user lying thereon are known. For example, a bench sold under the trademark Pancafit® has been sold in Italy, and is described in materials that were filed as part of the '040 application and thus form part of this application, including an English language copy of European patent specification EP 0999880 B1 (herein collectively, the "Pancafit® product"). Various drawbacks or limitations have been noted with the Pancafit® product, including that the body supporting surfaces sit almost directly on the floor, making it difficult or uncomfortable for some users to get on and off. It has also been noted that the Pancafit® product may be too weak, flimsy, and narrow for some users, especially for resistance training. It has further been observed that the mechanisms that allow portions of the Pancafit® product to pivot tend to stick instead of moving smoothly, and can be difficult and non-intuitive to understand how to use. Further, the Pancafit® product does not provide a surface to support a user's arms, but rather provides extendable handles for the user to grab with their hands. Moreover, a user of the Pancafit® product has to reach back behind her or his shoulders to grab the extendable handles, which can be uncomfortable or impossible for someone with an injury.

SUMMARY

The present invention(s) elegantly overcome many of the drawbacks of prior systems and provide numerous additional improvements and benefits as will be apparent to persons of skill in the art. Provided in various example embodiments are strong, easy and intuitive to use, articulating benches configured to better support a user in more potential positions while performing muscular stretching exercises, respiration exercises, and resistance training, all while having the capability to simultaneously help the user achieve parasympathetic activation. The bench's adjustable "V" angle, along with the separately pivotable support surfaces for each leg and separately-pivotable arm support surfaces, contribute to the superior sensation of three-dimensional or multi-planar support. Used in a variety of positions and postures, devices made according to various example embodiments can directly impact and positively influence joints, releasing chronically held muscle tension and facilitating helpful postures to get the user's body to naturally shift away from a sympathetic state (active, catabolic) and instead engage the parasympathetic nervous system (regenerative, anabolic). Essentially, the device can help the user relax by relieving areas of chronic physical stress, while simultaneously supporting the user's body during muscular stretching exercises, respiration exercises, and resistance training.

Accordingly, provided herein in various example embodiments is an articulating bench configured to support a user, comprising: a frame structure extending longitudinally about a first longitudinal axis, the frame structure sized, shaped, and constructed to support a back supporting portion and left and right leg supporting portions and the user lying thereon; the back supporting portion pivotably attached with the frame structure about a first horizontal axis perpendicular to the first longitudinal axis, the back supporting portion fixable at a first range of angles with respect to the frame structure, the back supporting portion sized, shaped, and constructed to extend underneath the entire length of and support the user's back and head when the user is lying on the articulating bench; the left leg supporting portion pivotably attached with the frame structure about a second horizontal axis perpendicular to the first longitudinal axis, the left leg supporting portion fixable at a second range of angles with respect to the frame structure, the left leg supporting portion sized, shaped, constructed, and located to extend underneath the entire length of and support the user's left leg and left foot when the user is lying on the articulating bench; and the right leg supporting portion pivotably attached with the frame structure about the second horizontal axis, the right leg supporting portion fixable at a third range of angles with respect to the frame structure and movable independently of the left leg supporting portion, the right leg supporting portion sized, shaped, constructed, and located to extend underneath the entire length of and support the user's right leg and right foot when the user is lying on the articulating bench.

In various example embodiments an articulating bench may further comprise a left arm supporting portion pivotably attached with the back supporting portion about a second longitudinal axis perpendicular to the first horizontal axis, the left arm supporting portion fixable at a fourth range of angles with respect to the back supporting portion, the left arm supporting portion sized, shaped, constructed, and located to extend underneath and support at least an upper portion of the user's left arm when the user is lying on the articulating bench; and a right arm supporting portion pivotably attached with the back supporting portion about a third longitudinal axis perpendicular to the first horizontal axis, the right arm supporting portion fixable at a fifth range of angles with respect to the back supporting portion and movable independently of the left arm supporting portion, the right arm supporting portion sized, shaped, constructed, and located to extend underneath and support at least an upper portion of the user's right arm when the user is lying on the articulating bench.

In various example embodiments the first and second horizontal axes are coaxial. In various example embodiments the first and second horizontal axes are not coaxial. In various example embodiments the first range of angles ranges from about zero degrees when the back supporting portion is horizontal, up to at least 45 degrees, 60 degrees, 75 degrees, or any other suitable angle. In various example embodiments the second and third ranges of angles each range from about zero degrees when the left leg supporting portion and the right leg supporting portion are each horizontal, up to at least up to at least 45 degrees, 60 degrees, 75 degrees, or any other suitable angle. In various example embodiments the fourth and fifth ranges of angles each range from at least about negative 90 degrees when the left arm supporting portion and the right arm supporting portion are each positioned approximately vertically downward relative to the back supporting portion, up to at least about positive 90 degrees when the left arm supporting portion and the right arm supporting portion are each positioned approximately vertically upward relative to the back supporting portion. In various example embodiments the back supporting portion, the left leg supporting portion, the right leg supporting portion, the left arm supporting portion, and the right arm supporting portion are all approximately coplanar when all of said portions are in approximately horizontal positions.

In various example embodiments the frame structure comprises a centrally-located central portion to which the back supporting portion and the left and right leg supporting portions are pivotably attached. In various example embodiments the frame structure further comprises a back support frame structure pivotably attached with the central portion and a leg support frame structure pivotably attached with the central bracket. In various example embodiments the frame structure is constructed to fold-up about the central portion by the back support frame structure and the leg support frame structure both independently pivoting about the central portion from about zero degrees when the back support frame structure and the leg support frame structure are approximately horizontal, up to approximately 90 degrees when the back support frame structure and the leg support frame structure are approximately vertical.

In various example embodiments the frame structure comprises: a centrally-located central portion to which the back supporting portion and the left and right leg supporting portions are pivotably attached; an adjustable back support linkage configured to fixably support the back supporting portion at the first range of angles with respect to the frame structure and comprising: a first member pivotably attached at a first end with the frame structure and extending to a second end slidably attached with the back supporting portion; a second member with a first end selectably attachable at different longitudinal locations on the frame structure and extending to a second end slidably attached with the back supporting portion; an adjustable left leg support linkage configured to fixably support the left leg supporting portion at the second range of angles with respect to the frame structure and comprising: a third member pivotably attached at a first end with the frame structure and extending to a second end slidably attached with the left leg supporting portion; a fourth member with a first end selectably attachable at different longitudinal locations on the frame structure and extending to a second end slidably attached with the left leg supporting portion; and an adjustable right leg support linkage configured to fixably support the right leg supporting portion at the third range of angles with respect to the frame structure and comprising: a fifth member pivotably attached at a first end with the frame structure and extending to a second end slidably attached with the right leg supporting portion; and a sixth member with a first end selectably attachable at different longitudinal locations on the frame structure and extending to a second end slidably attached with the right leg supporting portion. In various example embodiments the second member is selectably attachable at different longitudinal locations on the frame structure by selectably engaging first teeth in a first serrated member, the fourth member is selectably attachable at different longitudinal locations on the frame structure by selectably engaging second teeth in a second serrated member, and the sixth member is selectably attachable at different longitudinal locations on the frame structure by selectably engaging third teeth in a third serrated member. In various example embodiments the frame structure further comprises a back support frame structure supporting the adjustable back support linkage and pivotably attached with the central portion and a leg support frame structure supporting the adjustable left leg support linkage and the adjustable right leg support linkage and pivotably attached with the central bracket.

In various example embodiments the frame structure is constructed to fold-up about the central portion by the back support frame structure and the leg support frame structure both independently pivoting about the central portion from about zero degrees when the back support frame structure and the leg support frame structure are approximately horizontal, up to approximately 90 degrees when the back support frame structure and the leg support frame structure are approximately vertical.

Also provided in various example embodiments is an articulating bench configured to support a user lying thereon, comprising: frame means for supporting back supporting means and left and right leg supporting means and the user lying thereon; the back supporting means comprising means for pivotably supporting the entire length of the user's back and head when the user is lying on the articulating bench; the left leg supporting means comprising means for pivotably supporting the entire length of the user's left leg and left foot when the user is lying on the articulating bench; and the right leg supporting means comprising means for pivotably supporting the entire length of the user's right leg and right foot when the user is lying on the articulating bench; wherein the left leg supporting means and the right leg supporting means are pivotable independently of each other.

Further provided in various example embodiments is a method of supporting a user's body, comprising: providing an articulating bench configured to support a user, wherein the articulating bench comprises: a frame structure extending longitudinally about a first longitudinal axis, the frame structure sized, shaped, and constructed to support a back supporting portion and left and right leg supporting portions and the user lying thereon; the back supporting portion pivotably attached with the frame structure about a first horizontal axis perpendicular to the first longitudinal axis, the back supporting portion fixable at a first range of angles with respect to the frame structure, the back supporting portion sized, shaped, and constructed to extend underneath the entire length of and support the user's back and head when the user is lying on the articulating bench; the left leg supporting portion pivotably attached with the frame structure about a second horizontal axis perpendicular to the first longitudinal axis, the left leg supporting portion fixable at a second range of angles with respect to the frame structure, the left leg supporting portion sized, shaped, constructed, and located to extend underneath the entire length of and support the user's left leg and left foot when the user is lying on the articulating bench; and the right leg supporting portion pivotably attached with the frame structure about the second horizontal axis, the right leg supporting portion fixable at a third range of angles with respect to the frame structure and movable independently of the left leg supporting portion, the right leg supporting portion sized, shaped, constructed, and located to extend underneath the entire length of and support the user's right leg and right foot when the user is lying on the articulating bench; the method further comprising the steps of pivoting the back supporting portion about the first horizontal axis to a first angle with respect to the frame structure and pivoting the left leg supporting portion about the second horizontal axis to a second angle with respect to the frame structure and pivoting the right leg supporting portion about the second horizontal axis to a third angle with respect to the frame structure; and the user laying on the articulating bench so that the entire length of the user's back and head is supported by the back supporting portion, the entire length of user's left leg and left foot is supported by the left leg supporting portion, and the entire length of user's right leg and right foot is supported by the right leg supporting portion.

In various example embodiments of methods of supporting a user's body, the articulating bench may further comprise: a left arm supporting portion pivotably attached with the back supporting portion about a second longitudinal axis perpendicular to the first horizontal axis, the left arm supporting portion fixable at a fourth range of angles with respect to the back supporting portion, the left arm supporting portion sized, shaped, constructed, and located to extend underneath and support at least an upper portion of the user's left arm when the user is lying on the articulating bench; and a right arm supporting portion pivotably attached with the back supporting portion about a third longitudinal axis perpendicular to the first horizontal axis, the right arm supporting portion fixable at a fifth range of angles with respect to the back supporting portion and movable independently of the left arm supporting portion, the right arm supporting portion sized, shaped, constructed, and located to extend underneath and support at least an upper portion of the user's right arm when the user is lying on the articulating bench; wherein the method further comprises the steps of: pivoting left arm supporting portion about the second longitudinal axis to a fourth angle with respect to the back supporting portion and pivoting right arm supporting portion about the third longitudinal axis to a fifth angle with respect to the back supporting portion; and the user laying on the articulating bench so that at least an upper portion of the user's left arm is supported by the left arm supporting portion and at least an upper portion of the user's right arm is supported by the right arm supporting portion.

In various example embodiments of methods of supporting a user's body, the method may further comprise the step of the user, while lying on the articulating bench, performing any of the activities selected from the group consisting of: muscular stretching, respiration exercises, and resistance training.

Additional aspects, alternatives and variations as would be apparent to persons of skill in the art are also disclosed herein and are specifically contemplated as included as part of the invention, including but not limited to all the embodiments shown or discussed in the '040 application. The invention is set forth only in the claims as allowed by the patent office in this or related applications, and the following summary descriptions of certain examples are not in any way to limit, define or otherwise establish the scope of legal protection.

BRIEF DESCRIPTION OF THE DRAWINGS

Various embodiments are depicted in the accompanying drawings for illustrative purposes, and should in no way be interpreted as limiting the scope of the embodiments. Furthermore, various features of different disclosed embodiments can be combined to form additional embodiments, which are part of this disclosure. It will be understood that certain components and details may not appear in the Figure(s) to assist in more clearly describing the invention.

DETAILED DESCRIPTION OF EXAMPLE EMBODIMENTS

Reference is made herein to some specific examples of the present invention, including any best modes contemplated by the inventor for carrying out the invention. Examples of these specific embodiments are illustrated in the accompanying Figure(s). While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all in certain embodiments. Accordingly, some implementations of the methods discussed herein may include more or fewer steps than those shown or described. Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

Figure 1:
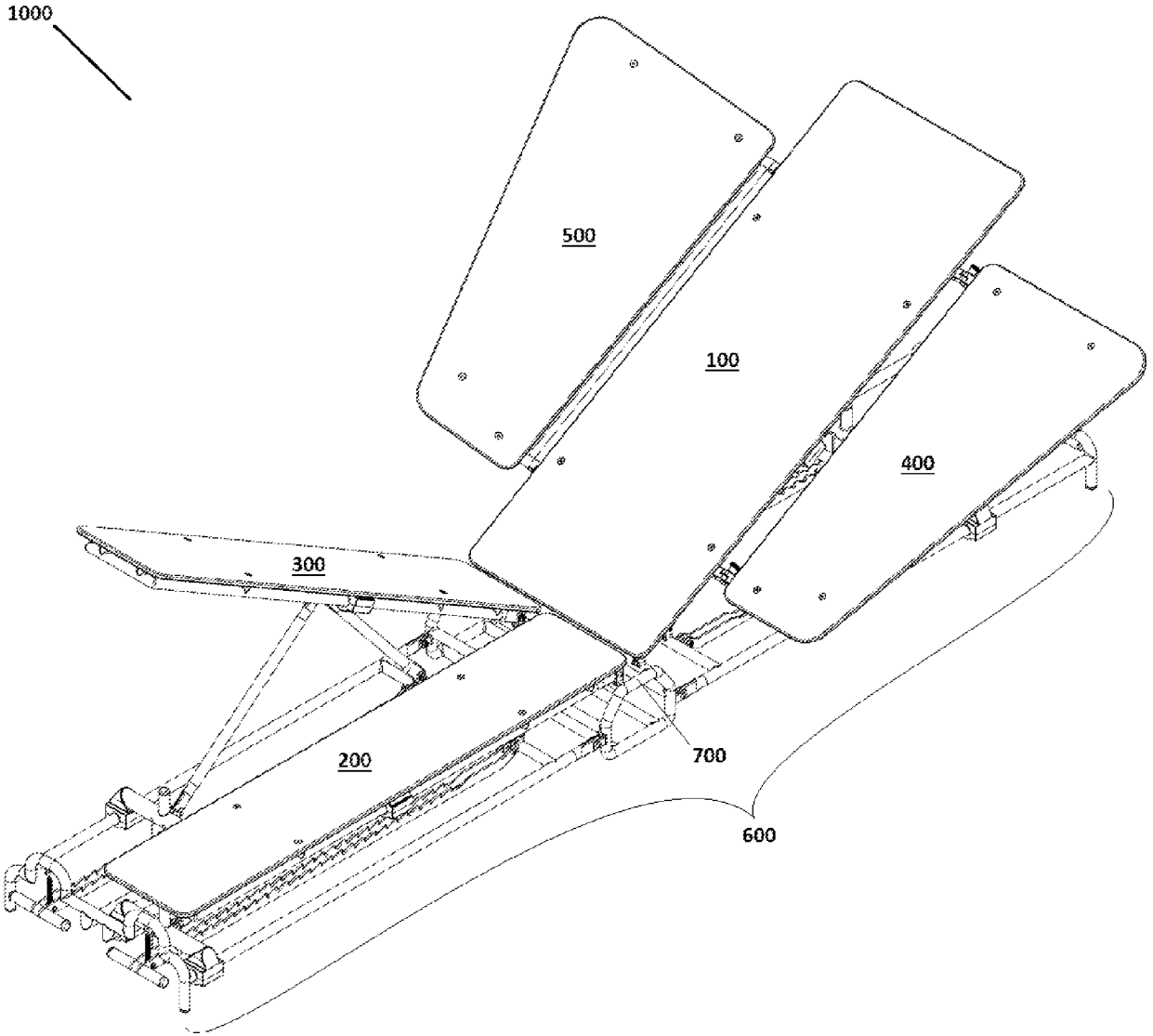
FIG. 1 is a perspective illustration of an example articulating bench configured to support a user, showing an example back supporting portion and example left and right leg supporting portions all positioned at various example angles with respect to an example frame structure, and example left and right arm supporting portions at various example angles with respect to the back supporting portion, according to various example embodiments.
Figure 2:
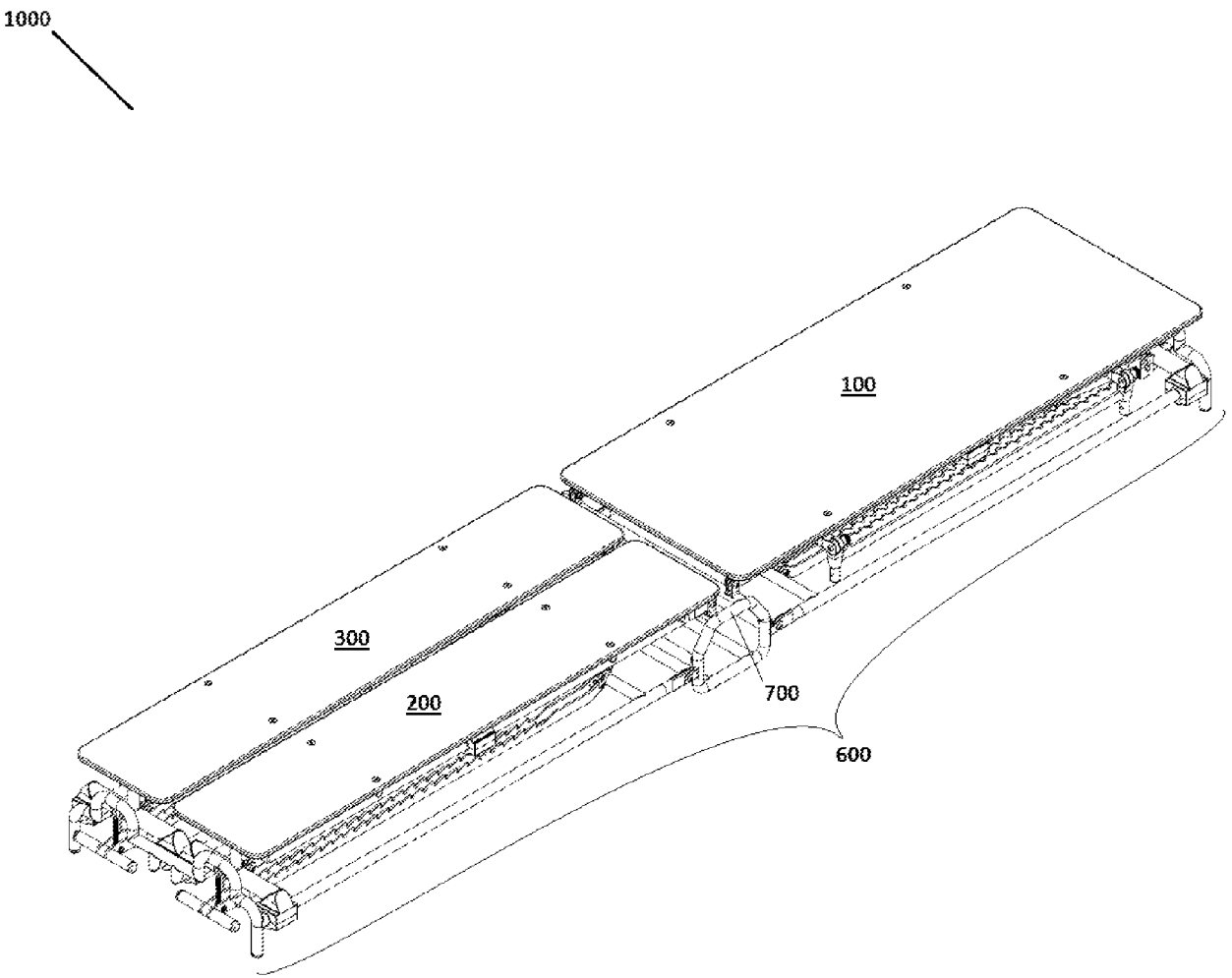
FIG. 2 is a perspective illustration of the example articulating bench of FIG. 1, showing the back supporting portion and left and right leg supporting portions all in a coplanar horizontal position at a zero angle with respect to the frame structure.
Figure 3:
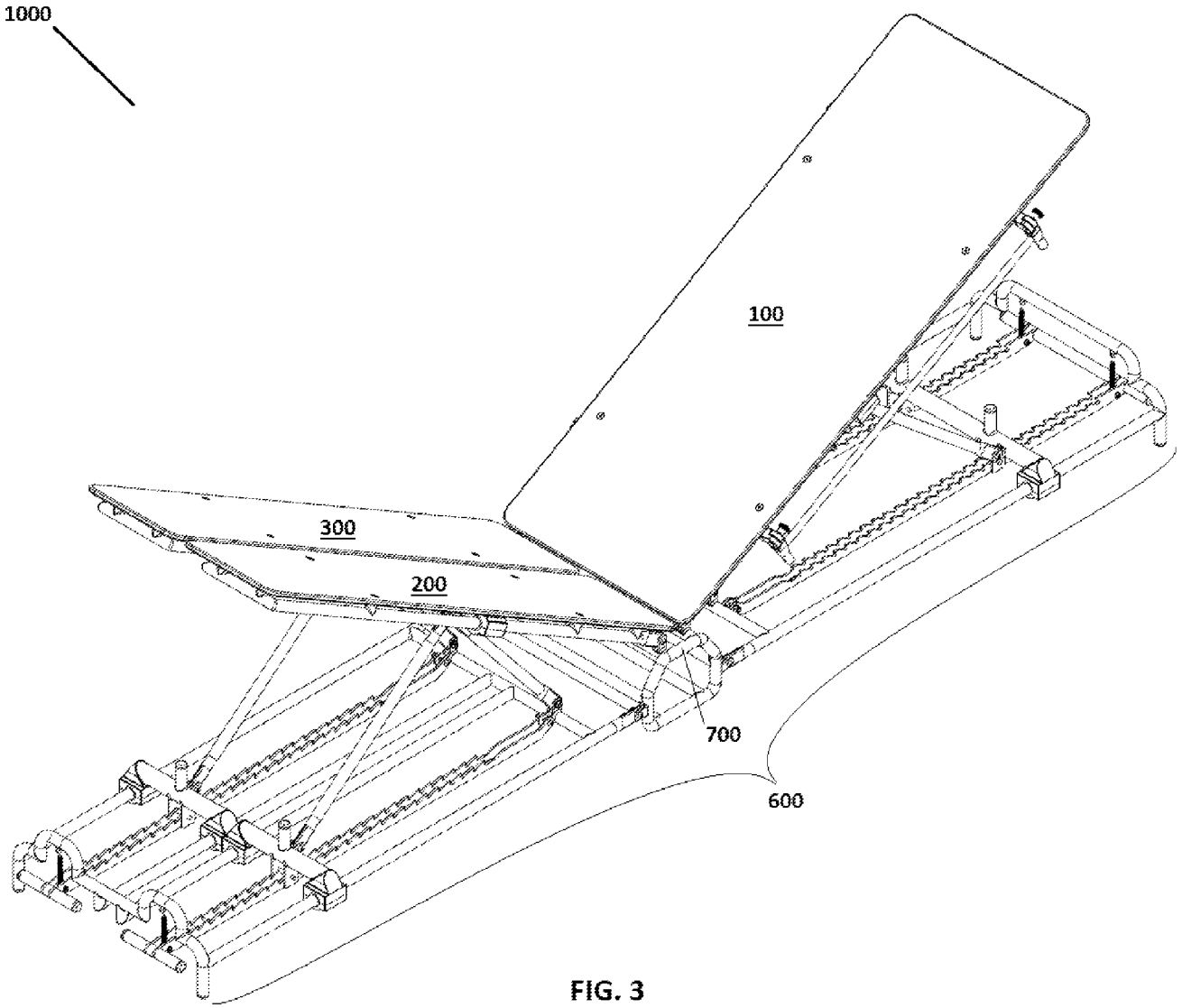
FIG. 3 is a perspective illustration of the example articulating bench of FIG. 1, showing the back supporting portion at a first angle with respect to the frame structure, and the left and right leg supporting portions in a coplanar position at a second angle with respect to the example frame structure similar to the first angle.
Figure 4:
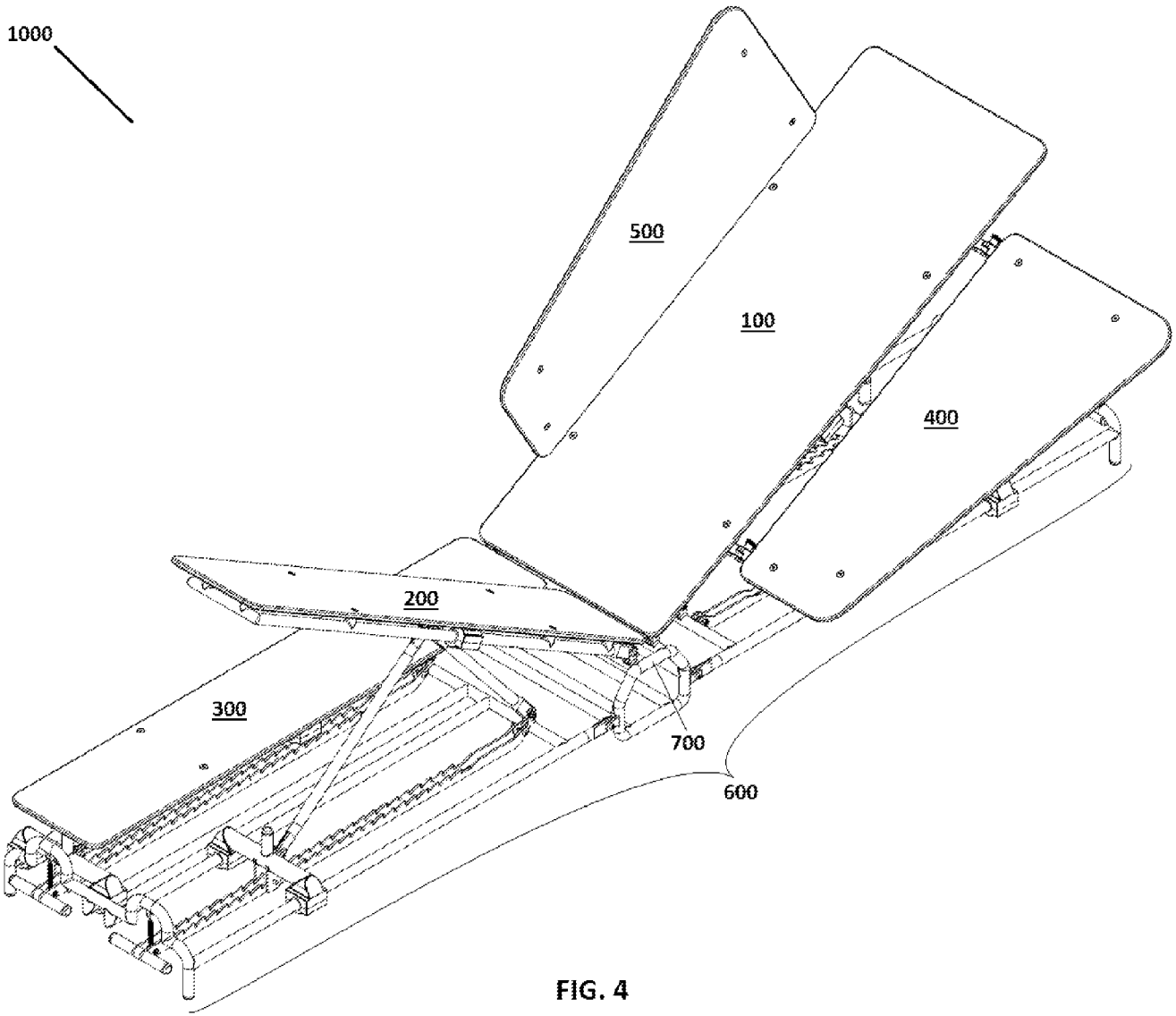
FIG. 4 is a perspective illustration of the example articulating bench of FIG. 1, showing the back supporting portion at a first angle with respect to the frame structure, the left leg supporting portion at an angle with respect to the frame structure similar to the first angle, the right leg supporting portion in a horizontal position at a zero angle with respect to the frame structure, the left arm supporting portion coplanar with and at a zero angle with respect to the back supporting portion, and the right arm supporting portion in a vertical position at a 90 degree angle with respect to the back supporting portion.
Figure 5:
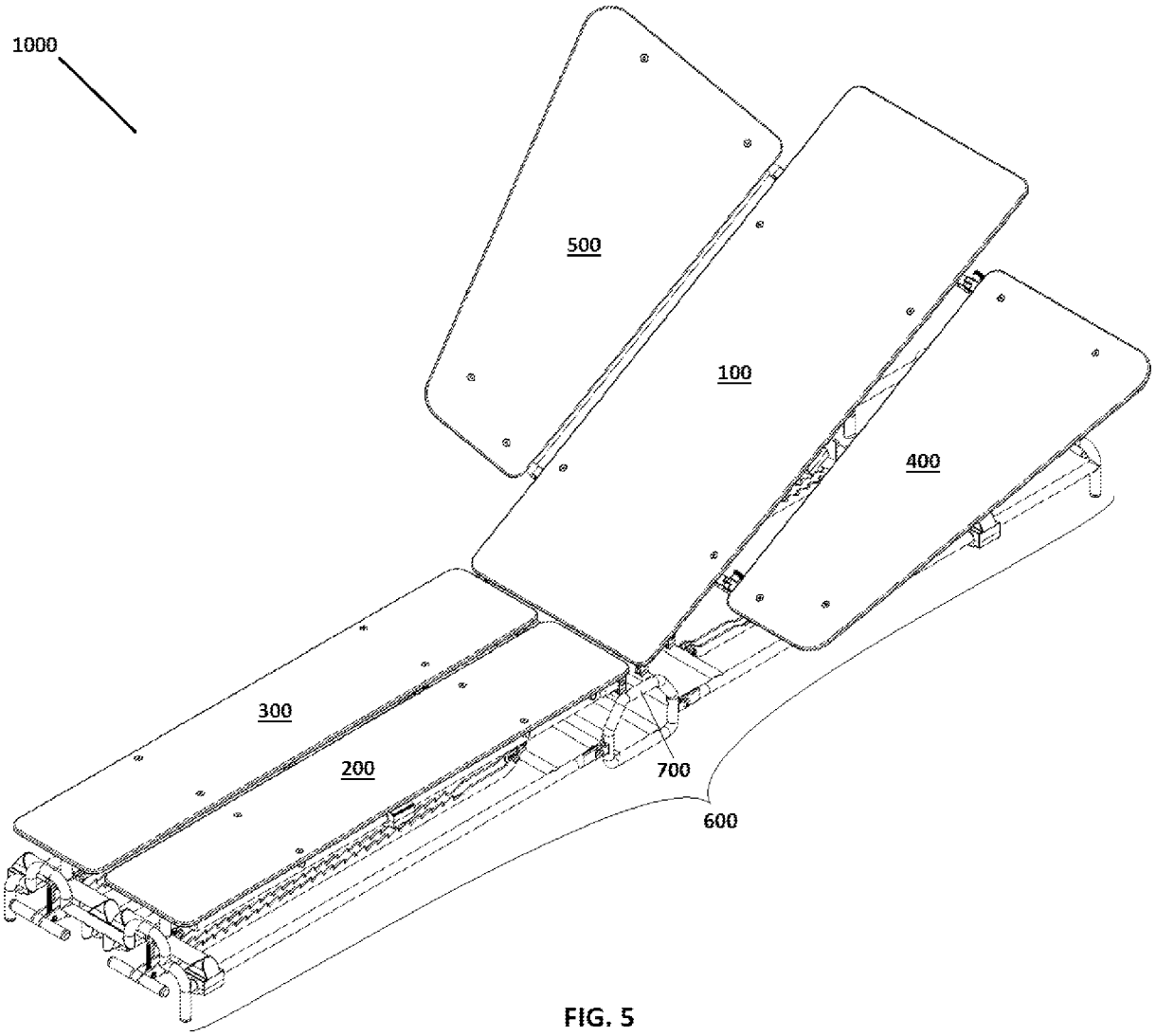
FIG. 5 is a perspective illustration of the example articulating bench of FIG. 1, showing the back supporting portion at a first angle with respect to the frame structure, the left and right leg supporting portions both in a coplanar horizontal position at a zero angle with respect to the frame structure, the left arm supporting portion coplanar with and at a zero angle with respect to the back supporting portion, and the right arm supporting portion at an example positive angle with respect to the back supporting portion.
Figure 11:
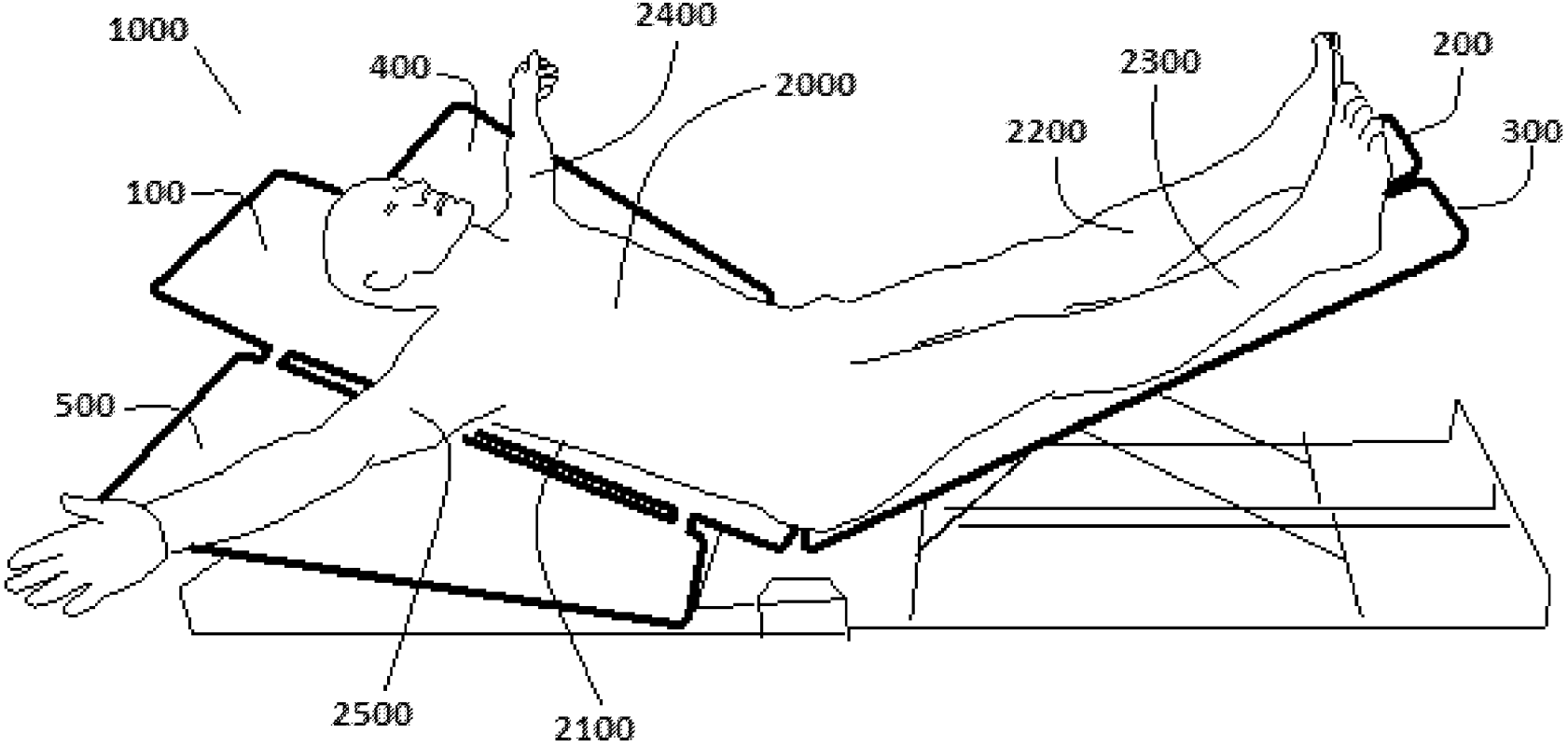
FIG. 11 is a perspective view of an example user lying on an example articulating bench according to various example embodiments.

Turning to FIGS. 1 through 6, shown is a perspective illustration of an example articulating bench 1000 configured to support a user 2000 (an example of which is shown in FIG. 11), showing an example back supporting portion 100, example left leg supporting portion 200 and right leg supporting portion 300, all pivotable about a central portion 700 of an example frame structure 600, and all positioned at various example angles with respect to the example frame structure 600. Also shown in FIGS. 1, 4, and 5 are example removably-attached (for instance with fasteners, not shown) left and right arm supporting portions, 400, 500, respectively, positioned at various example angles with respect to the back supporting portion 100, according to various example embodiments.

Figure 6:
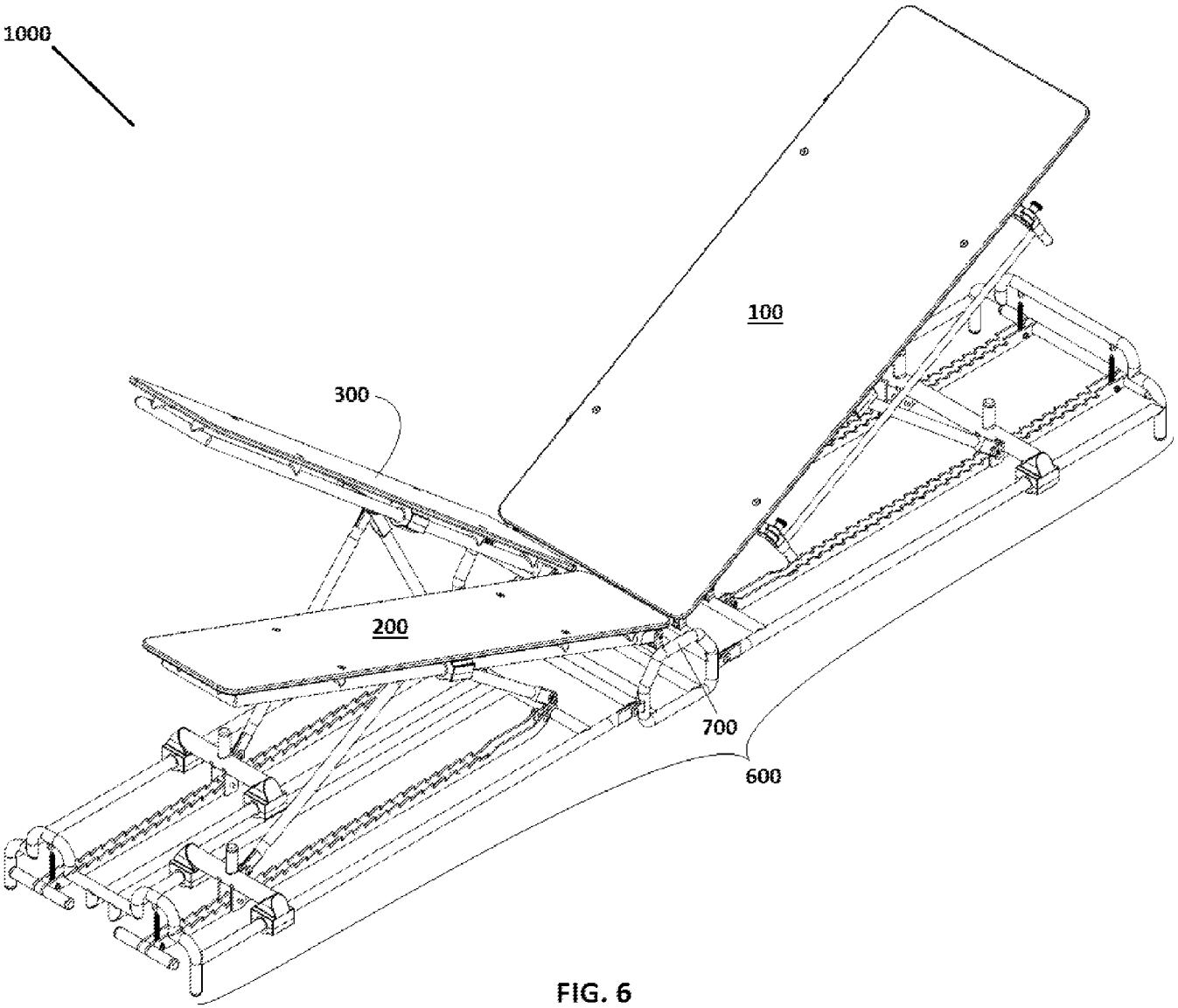
FIG. 6 is a perspective illustration of the example articulating bench of FIG. 1, showing the back supporting portion at a first angle with respect to the frame structure, and the left and right leg supporting portions at various other angles with respect to the frame structure.
Figure 7:
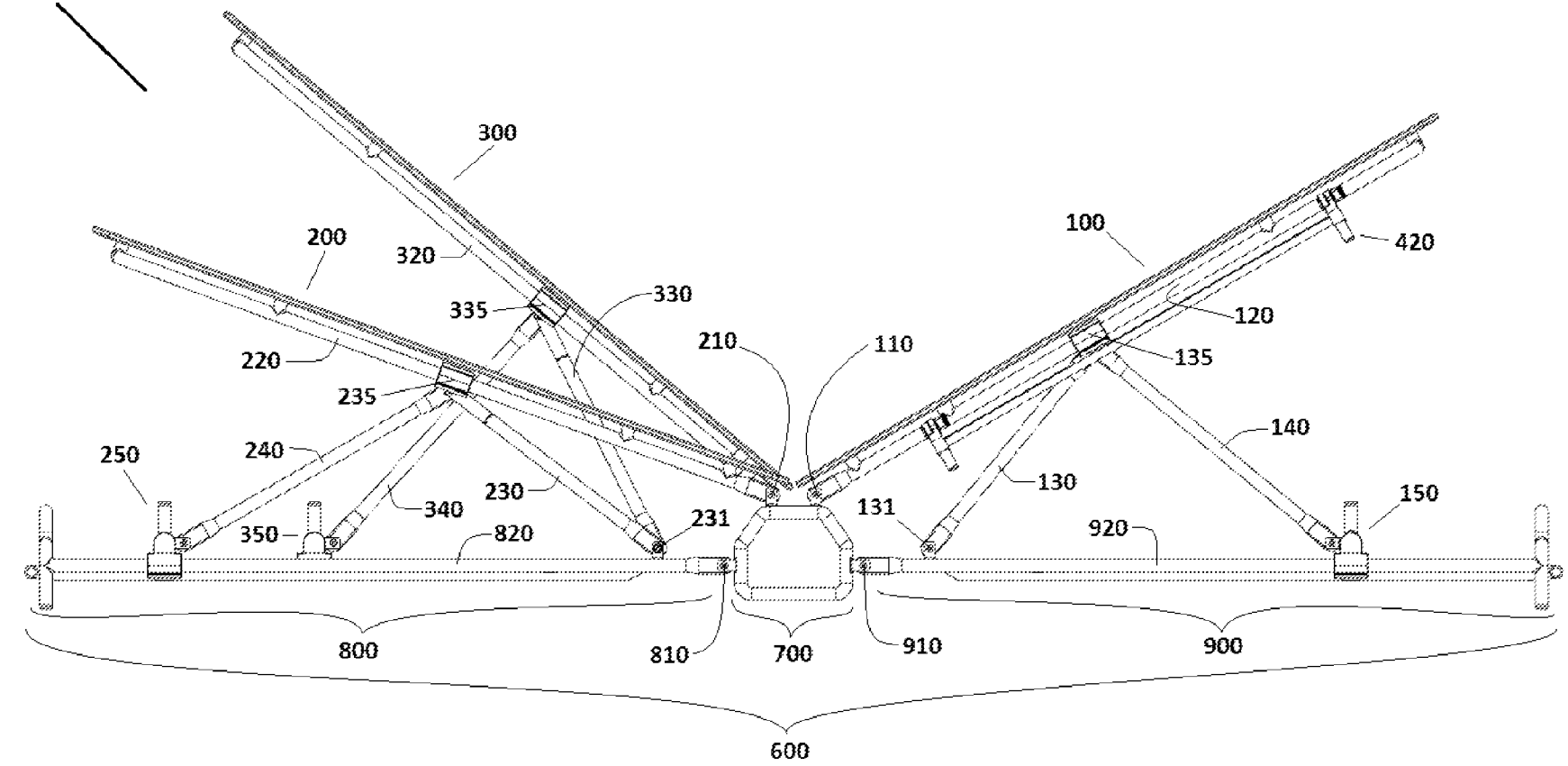
FIG. 7 is a left side elevation view of the example articulating bench of FIG. 1 showing the back supporting portion and the left and right leg supporting portions at the angles shown in FIG. 6.
Figure 9:
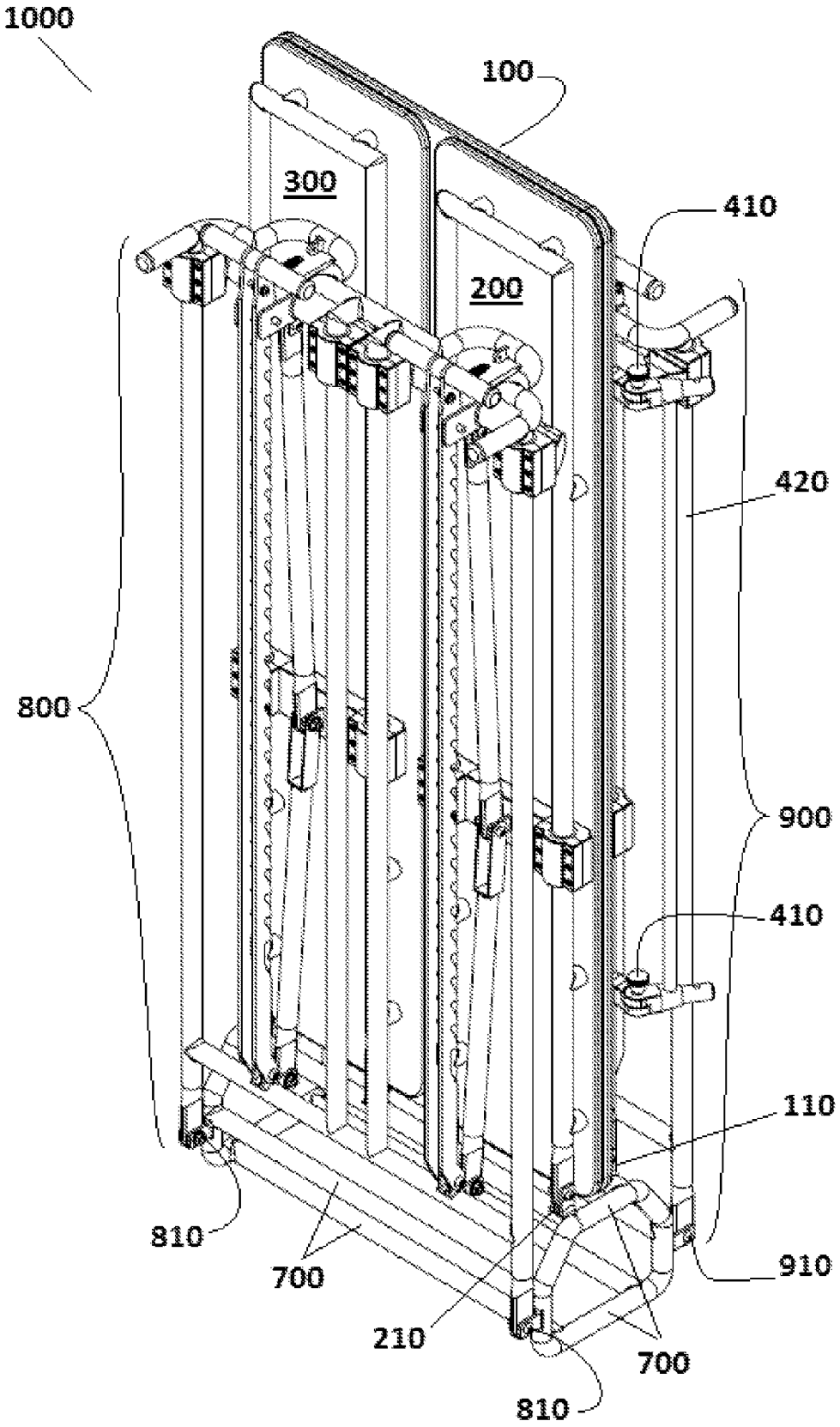
FIG. 9 is a perspective illustration of the example articulating bench of FIG. 1, showing the bench folded-up about a central portion of the example frame structure.

FIG. 7 is a left side elevation view of the example articulating bench of FIG. 1 showing the back supporting portion 100 and the left and right leg supporting portions 200, 300 at the angles shown in FIG. 6. Provided in various example embodiments is a frame structure 600 extending longitudinally about a first longitudinal axis (i.e., any line extending horizontally left to right across FIG. 7), the frame structure 600 sized, shaped, and constructed to support a back supporting portion 100 and left and right leg supporting portions 200, 300 and the user 2000 lying thereon, for instance as shown in FIG. 11. In various example embodiments the user may weigh up to 300 pounds, or more in various examples. The frame structure may comprise a centrally-located central portion 700 to which the back supporting portion 100 and the left and right leg supporting portions 200, 300 are pivotably attached, as shown in the Figures. The frame structure may further comprise a back support frame structure 900 pivotably attached with the central portion 700 and a leg support frame structure 800 pivotably attached with the central portion 700. As illustrated in FIG. 9, the frame structure 600 may be constructed to fold-up about the central portion 700 by the back support frame structure 900 and the leg support frame structure 800 both independently pivoting about the central portion 700 from about zero degrees when the back support frame structure 900 and the leg support frame structure 800 are approximately horizontal (as shown in FIGS. 1-7), up to approximately 90 degrees when the back support frame structure 900 and the leg support frame structure 800 are approximately vertical, as depicted in FIG. 9. This option provides for compact storage of the articulating bench 1000, which can be readily unfolded to the position shown in FIGS. 1-7. The frame structure 600 may be formed from any suitable material, such as, for example, steel or aluminum, in tubular, extruded, cast, or other suitable form, and may be assembled from many individual pieces or may be manufactured as one unitary structure or an assembly of unitary sub-structures.

With continuing reference to FIGS. 1-7, the back supporting 100 portion may be pivotably attached with the frame structure 600 about a first horizontal axis 110 perpendicular to the first longitudinal axis (i.e., in FIG. 7 the first horizontal axis 110 would extend perpendicularly out of the page). The first horizontal axis 110 may comprise a pivotable joint located on a central portion 700 of the frame 600. The back supporting portion 100 may be fixable at a first range of angles with respect to the frame structure 600, for example as depicted in FIGS. 2, 3, and 7. In various example embodiments the first range of angles may range from about zero degrees when the back supporting portion 100 is horizontal as shown in FIG. 2, up to at least 45 degrees, 60 degrees, 75 degrees, or any other suitable angle. The back supporting portion 100 may be sized, shaped, and constructed to extend underneath the entire length of and support the back 2100 and head of the user 2000 when the user 200 is lying on the articulating bench 1000, for instance as shown in FIG. 11. In one example embodiment the back supporting portion 100 may be formed in the shape of a rectangle about 42 inches long by about 17 inches wide with one-inch radius corners, and is constructed of wood about ⅜ of an inch thick. However, any suitable dimensions may be used. The back supporting portion 100 may be constructed from any suitable material, such as wood, metal, plastic, or composite material, may be covered in upholstery or padding (not shown), and may alternatively be constructed of fabric stretched over a perimeter frame (not shown).

The left leg supporting portion 200 may be pivotably attached with the frame structure 600 about a second horizontal axis 210 perpendicular to the first longitudinal axis (i.e., in FIG. 7 the second horizontal axis 210 would extend perpendicularly out of the page). The second horizontal axis 210 may comprise a pivotable joint located on a central portion 700 of the frame 600. The left leg supporting portion 200 may be fixable at a second range of angles with respect to the frame structure 600, for example as depicted in FIGS. 1 through 4. In various example embodiments the second range of angles may range from about zero degrees when the left leg supporting portion 200 is horizontal as shown in FIG. 2, up to at least 45 degrees, 60 degrees, 75 degrees, or any other suitable angle. The left leg supporting portion 200 may be sized, shaped, constructed, and located to extend underneath the entire length of and support the user's left leg 2200 and left foot when the user 2000 is lying on the articulating bench 1000, for instance as shown in FIG. 11. In one example embodiment the left leg supporting portion 200 may be formed in the shape of a rectangle about 42 inches long by about 8.25 inches wide with one-inch radius corners, and is constructed of wood about ⅜ of an inch thick. However, any suitable dimensions may be used. The left leg supporting portion 200 may be constructed from any suitable material, such as wood, metal, plastic, or composite material, may be covered in upholstery or padding (not shown), and may alternatively be constructed of fabric stretched over a perimeter frame (not shown).

The right leg supporting portion 300 may be pivotably attached with the frame structure 600 about the same second horizontal axis 210 as the left leg supporting portion 200, and may likewise comprise a pivotable joint located on a central portion 700 of the frame 600. While in the example embodiment shown in the Figures the first and second horizontal axes 110, 210 are separated longitudinally on the central portion 700 of the frame structure 600 and thus are not coaxial, in other example embodiments the first and second horizontal axes 110, 210 may be the same axis and thus coaxial, for instance as depicted in certain embodiments in the '040 application. The right leg supporting portion 300 may be fixable at a third range of angles with respect to the frame structure 600, for example as depicted in FIGS. 1 through 4, and may be movable independently of the left leg supporting portion 200, as depicted in the Figures. In various example embodiments the third range of angles may range from about zero degrees when the right leg supporting portion 300 is horizontal as shown in FIG. 2, up to at least 45 degrees, 60 degrees, 75 degrees, or any other suitable angle. The right leg supporting portion 300 may be sized, shaped, constructed, and located to extend underneath the entire length of and support the user's right leg 2300 and right foot when the user 2000 is lying on the articulating bench 1000, for instance as shown in FIG. 11. In one example embodiment the right leg supporting portion 300 may be formed in the shape of a rectangle about 42 inches long by about 8.25 inches wide with one-inch radius corners, and is constructed of wood about ⅜ of an inch thick. However, any suitable dimensions may be used. The right leg supporting portion 300 may be constructed from any suitable material, such as wood, metal, plastic, or composite material, may be covered in upholstery or padding (not shown), and may alternatively be constructed of fabric stretched over a perimeter frame (not shown).

Figure 8B:
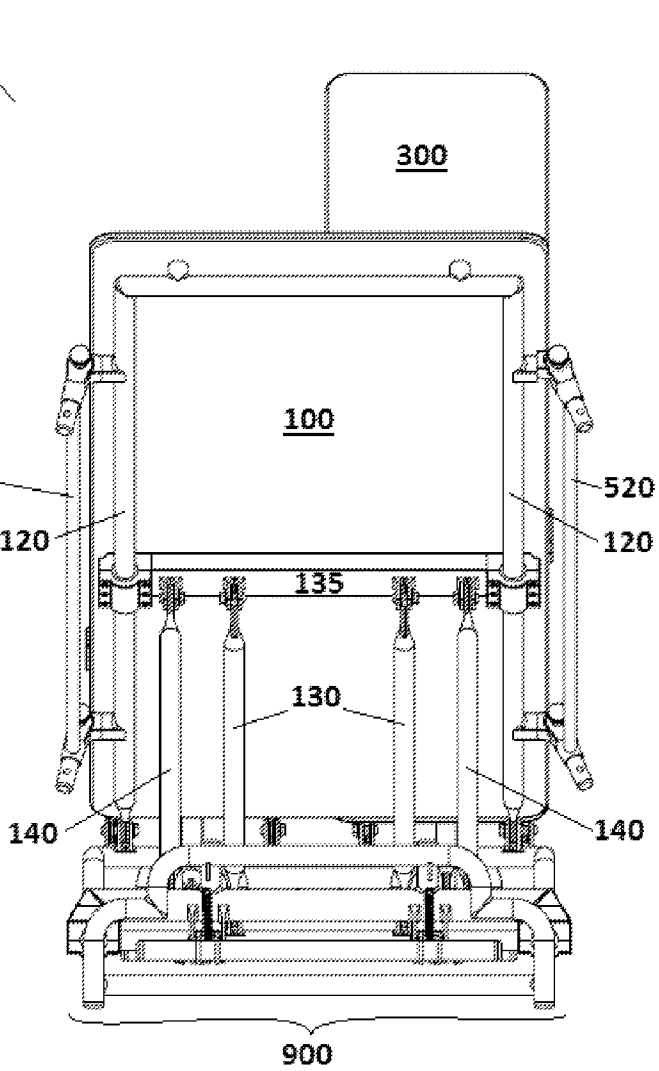
FIG. 8B is rear elevation view of the example articulating bench of FIG. 1 showing the back supporting portion and the left and right leg supporting portions at the angles shown in FIG. 6.
Figure 8A:
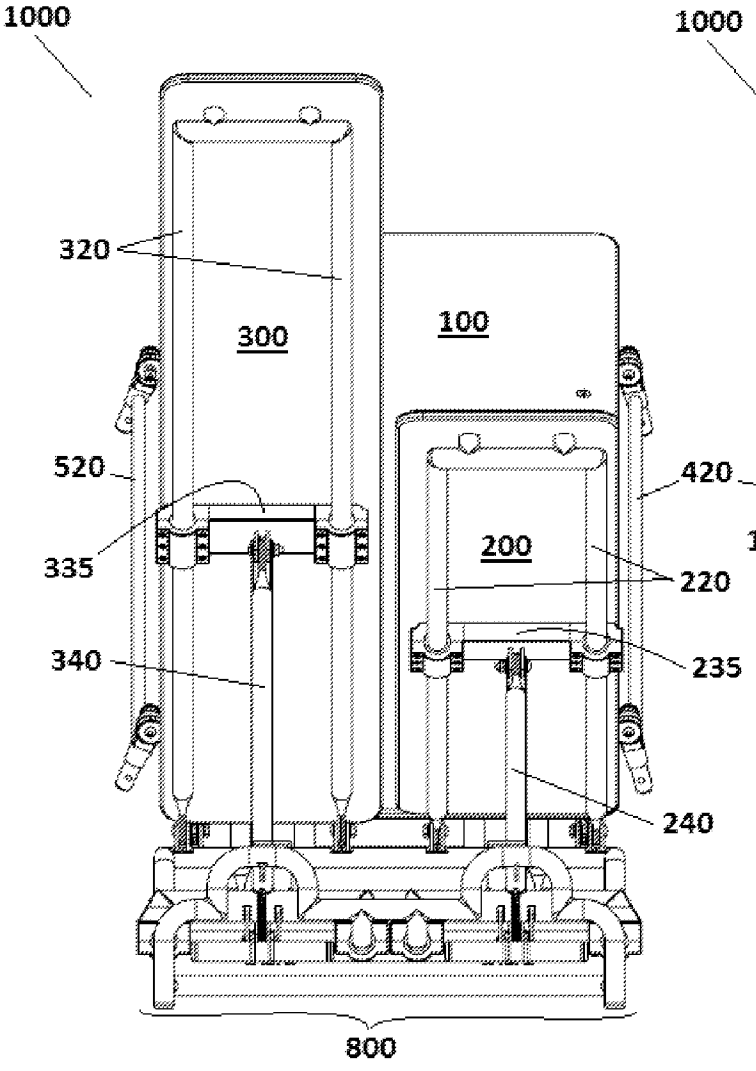
FIG. 8A is front elevation view of the example articulating bench of FIG. 1 showing the back supporting portion and the left and right leg supporting portions at the angles shown in FIG. 6.

Also provided in various example embodiments is a left arm supporting portion 400 pivotably attached with the back supporting portion 100 about a second longitudinal axis 410 (FIG. 9) perpendicular to the first horizontal axis 110. The left arm supporting portion 400 may also be removably attached with the back supporting portion 100 via bracketry 420 (FIGS. 9, 8A, 8B). The left arm supporting portion 400 may be fixable at a fourth range of angles with respect to the back supporting portion 100, for example as depicted in FIGS. 1, 4, and 5. Any suitable mechanism for fixing the location of the left arm supporting portion 400 with respect to the back supporting portion 100 may be used, such as a locking pivot joint, or any of the structures shown in the Figures, including as shown in the '040 application. In various example embodiments the fourth range of angles can range from at least about negative 90 degrees when the left arm supporting portion 400 is positioned approximately vertically downward relative to the back supporting portion 100 (not shown), up to at least about positive 90 degrees when the left arm supporting portion 400 is positioned approximately vertically upward relative to the back supporting portion 100 (for instance as shown with respect to the right arm supporting portion 500 as positioned in FIG. 4). The left arm supporting portion 400 may be sized, shaped, constructed, and located to extend underneath and support at least an upper portion 2400 of the user's left arm when the user 2000 is lying on the articulating bench 1000, for instance as shown in FIG. 11. In one example embodiment the left arm supporting portion 400 may be formed in the shape of a right trapezoid about 30 inches long by about 9 inches wide at the bottom increasing to about 16 inches wide at the top, with one-inch radius inner corners and two-inch radius outer corners, and is constructed of wood about ⅜ of an inch thick. However, any suitable dimensions may be used. The left arm supporting portion 400 may be constructed from any suitable material, such as wood, metal, plastic, or composite material, may be covered in upholstery or padding (not shown), and may alternatively be constructed of fabric stretched over a perimeter frame (not shown).

Further provided in various example embodiments is a right arm supporting portion 500 pivotably attached with the back supporting portion 100 about a third longitudinal axis (parallel to 410 in FIG. 9, but on the opposite side of the back supporting portion 100), which like second longitudinal axis 410 is perpendicular to the first horizontal axis 110. The right arm supporting portion 500 may also be removably attached with the back supporting portion 100 via bracketry 520 (FIGS. 8A, 8B). The right arm supporting portion 500 may be fixable at a fifth range of angles with respect to the back supporting portion 100, for example as depicted in FIGS. 1, 4, and 5. Any suitable mechanism for fixing the location of the right arm supporting portion 500 with respect to the back supporting portion 100 may be used, such as a locking pivot joint, or any of the structures shown in the Figures, including as shown in the '040 application. In various example embodiments the fifth range of angles can range from at least about negative 90 degrees when the right arm supporting portion 500 is positioned approximately vertically downward relative to the back supporting portion 100 (not shown), up to at least about positive 90 degrees when the right arm supporting portion 500 is positioned approximately vertically upward relative to the back supporting portion 100 (for instance as shown in FIG. 4). The right arm supporting portion 500 may be sized, shaped, constructed, and located to extend underneath and support at least an upper portion 2500 of the user's right arm when the user 2000 is lying on the articulating bench 1000, for instance as shown in FIG. 11. In one example embodiment the right arm supporting portion 500 may be formed in the shape of a right trapezoid about 30 inches long by about 9 inches wide at the bottom increasing to about 16 inches wide at the top, with one-inch radius inner corners and two-inch radius outer corners, and is constructed of wood about ⅜ of an inch thick. However, any suitable dimensions may be used. The right arm supporting portion 500 may be constructed from any suitable material, such as wood, metal, plastic, or composite material, may be covered in upholstery or padding (not shown), and may alternatively be constructed of fabric stretched over a perimeter frame (not shown).

In various example embodiments, the back supporting portion 100 and the left leg supporting portion 200 and the right leg supporting portion 300 are all approximately coplanar when all of said portions are in approximately horizontal positions, for instance as shown in FIG. 2. Where a left arm supporting portion 400 and a right arm supporting portion 500 are provided, the back supporting portion 100, the left leg supporting portion 200, the right leg supporting portion 300, the left arm supporting portion 400, and the right arm supporting portion 500 are all approximately coplanar when all of said portions are in approximately horizontal positions (not shown but understood in view of FIGS. 1 and 2).

With reference to FIGS. 7-10, example structure will now be described for fixably locating the pivoting back supporting portion 100 and left and right leg portions 200, 300 at various angles with respect to the frame structure 600. In various example embodiments, the frame structure 600 may comprise a centrally-located central portion 700 to which the back supporting portion 100 and the left and right leg supporting portions 200, 300 are pivotably attached, as shown in FIGS. 1-10.

An adjustable back support linkage may be provided that is configured to fixably support the back supporting portion 100 at the first range of angles with respect to the frame structure 600, in which the adjustable back support linkage comprises a first member 130 pivotably attached at a first end 131 with the frame structure 600 and extending to a second end slidably attached with a slide tube 120 on the back supporting portion 100 by a sliding connector 135. A second member 140 may be provided with a first end 150 selectably attachable at different longitudinal locations on the frame structure 600 and extending to a second end slidably attached with the back supporting portion 100 by the sliding connector 135. Two or more of these adjustable back support linkages may be provided to robustly support the back supporting portion 100, for instance as shown in FIG. 8B.

An adjustable left leg support linkage may be provided that is configured to fixably support the left leg supporting portion 200 at the second range of angles with respect to the frame structure 600, in which the adjustable left leg support linkage comprises a third member 230 pivotably attached at a first end 231 with the frame structure 600 and extending to a second end slidably attached with a slide tube 220 on the left leg supporting portion 200 by a sliding connector 235. A fourth member 240 may be provided with a first end 250 selectably attachable at different longitudinal locations on the frame structure 600 and extending to a second end slidably attached with the left leg supporting portion 200 by the sliding connector 235.

An adjustable right leg support linkage configured to fixably support the right leg supporting portion 300 at the third range of angles with respect to the frame structure 600, in which the adjustable left leg support linkage comprises a fifth member 330 pivotably attached at a first end 231 with the frame structure 600 and extending to a second end slidably attached with a slide tube 320 on the right leg supporting portion 300 by a sliding connector 335. A sixth member 340 may be provided with a first end 350 selectably attachable at different longitudinal locations on the frame structure 600 and extending to a second end slidably attached with the right leg supporting portion 300 by the sliding connector 335.

Figure 10:
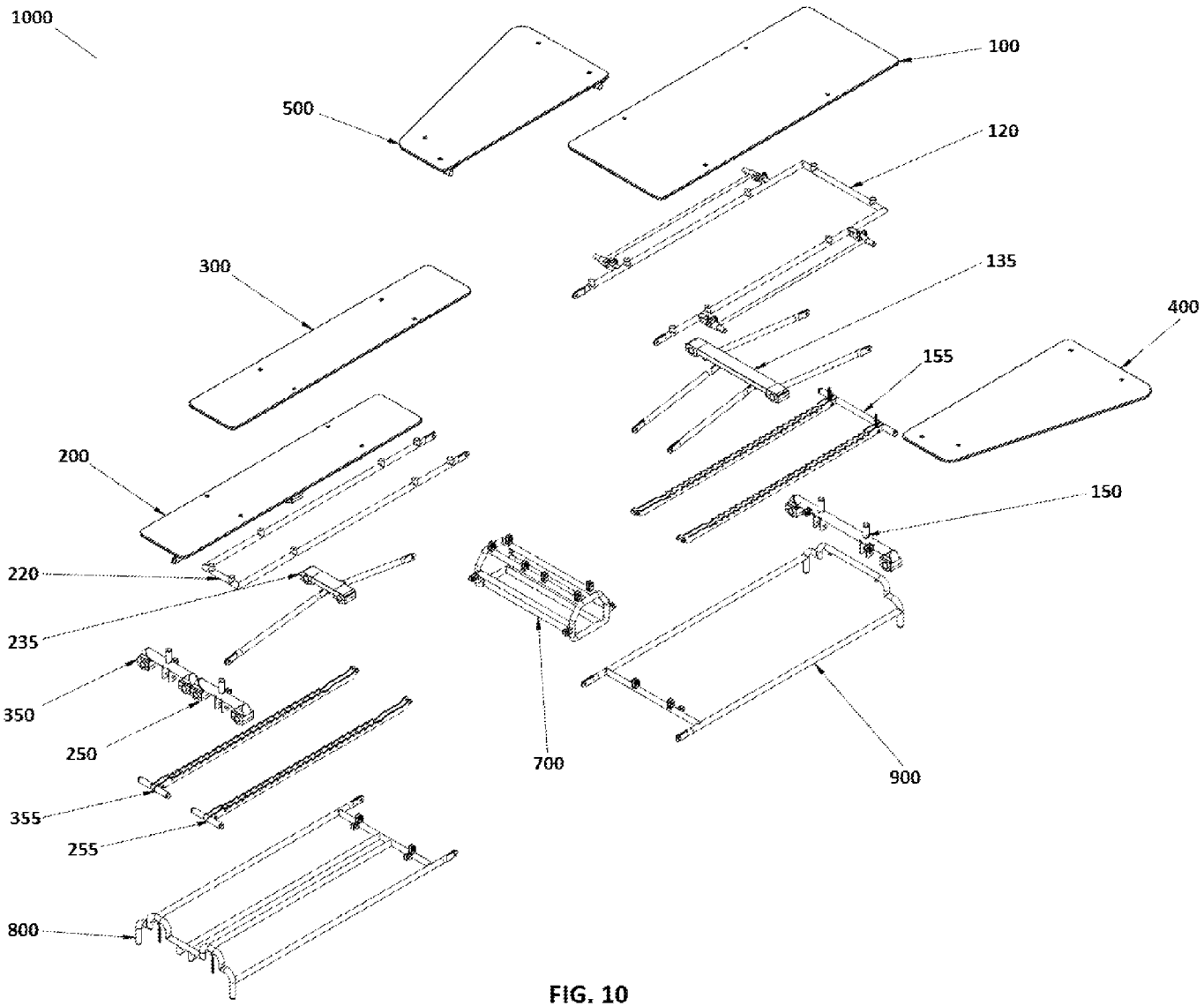
FIG. 10 is a perspective exploded view of various example components of the example articulating bench of FIG. 1.

With reference to FIGS. 7 and 10 and as visible in FIGS. 3 and 6, in various example embodiments the second member 140 may be selectably attachable at different longitudinal locations on the frame structure 600 by selectably engaging its first end 150 with first teeth in a first serrated member 155. As noted herein, two or more of these adjustable back support linkages may be provided to robustly support the back supporting portion 100, for instance as shown in FIG. 8B. Similarly, fourth member 240 may be selectably attachable at different longitudinal locations on the frame structure 600 by selectably engaging its first end 250 with second teeth in a second serrated member 255. Finally, sixth member 340 may be selectably attachable at different longitudinal locations on the frame structure 600 by selectably engaging its first end 350 with third teeth in a third serrated member 355.

Turning to FIG. 11, in use, an articulating bench 1000 may be provided as described herein, wherein a user 2000 or someone assisting the user (not shown) may pivot the back supporting portion 100 about the first horizontal axis 110 to a first angle with respect to the frame structure 600, and/or pivot the left leg supporting portion 200 about the second horizontal axis 210 to a second angle with respect to the frame structure 600, and/or pivot the right leg supporting portion 300 about the second horizontal axis 210 to a third angle with respect to the frame structure 600. Before or after any of the above steps, the user 2000 may lay on the articulating bench 1000 so that the entire length of the user's back 2100 and head is supported by the back supporting portion 100, the entire length of user's left leg 2200 and left foot is supported by the left leg supporting portion 200, and the entire length of user's right leg 2300 and right foot is supported by the right leg supporting portion 300. Where left arm and right arm supporting portions 400, 500 are provided and installed on the bench 1000, a user 2000 or someone assisting the user (not shown) may pivot the left arm supporting portion 400 about the second longitudinal axis 410 to a fourth angle with respect to the back supporting portion 100, and/or pivot right arm supporting portion about the third longitudinal axis (same as 410 but on the other side of back supporting portion 100) to a fifth angle with respect to the back supporting portion 100. Before or after any of the above steps, the user 2000 may lay on the articulating bench 1000 so that at least an upper portion of the user's left arm 2400 is supported by the left arm supporting portion 400 and at least an upper portion of the user's right arm 2500 is supported by the right arm supporting portion 500. While lying on the articulating bench 1000, the user 2000, either alone or with the assistance of another person (not shown), may perform any suitable activities, such as, for example, muscular stretching, respiration exercises, and resistance training. Users 2000 may use the articulating bench 1000 in other ways in addition to lying on their back 2100 as shown in FIG. 11, to produce any number of desired postures and positions using the adjustably angled supporting surfaces provided by the articulating bench 1000.

Any of the suitable technologies and materials set forth and incorporated herein may be used to implement various example aspects of the invention as would be apparent to one of skill in the art. Although exemplary embodiments and applications of the invention have been described herein including as described above and shown in the included example Figure(s), there is no intention that the invention be limited to these exemplary embodiments and applications or to the manner in which the exemplary embodiments and applications operate or are described herein. Indeed, many variations and modifications to the exemplary embodiments are possible as would be apparent to a person of ordinary skill in the art. The invention may include any device, structure, method, or functionality, as long as the resulting device, system or method falls within the scope of one of the claims that are allowed by the patent office based on this or any related patent application.

What is claimed is:

1. An articulating bench configured to support a user, comprising:

a frame structure extending longitudinally about a first longitudinal axis, the frame structure sized, shaped, and constructed to support a back supporting portion and left and right leg supporting portions and the user lying thereon;

the back supporting portion pivotably attached with the frame structure about a first horizontal axis perpendicular to the first longitudinal axis, the back supporting portion fixable at a first range of angles with respect to the frame structure, the back supporting portion sized, shaped, and constructed to extend underneath the entire length of and support the user's back and head when the user is lying on the articulating bench;

the left leg supporting portion pivotably attached with the frame structure about a second horizontal axis perpendicular to the first longitudinal axis, the left leg supporting portion fixable at a second range of angles with respect to the frame structure, the left leg supporting portion sized, shaped, constructed, and located to extend underneath the entire length of and support the user's left leg and left foot when the user is lying on the articulating bench; and the right leg supporting portion pivotably attached with the frame structure about the second horizontal axis, the right leg supporting portion fixable at a third range of angles with respect to the frame structure and movable independently of the left leg supporting portion, the right leg supporting portion sized, shaped, constructed, and located to extend underneath the entire length of and support the user's right leg and right foot when the user is lying on the articulating bench;

wherein the frame structure comprises:

a centrally-located central portion to which the back supporting portion and the left and right leg supporting portions are pivotably attached;

an adjustable back support linkage configured to fixably support the back supporting portion at the first range of angles with respect to the frame structure and comprising:

a first member pivotably attached at a first end with the frame structure and extending to a second end slidably attached with the back supporting portion;

a second member with a first end selectably attachable at different longitudinal locations on the frame structure and extending to a second end slidably attached with the back supporting portion;

an adjustable left leg support linkage configured to fixably support the left leg supporting portion at the second range of angles with respect to the frame structure and comprising:

a third member pivotably attached at a first end with the frame structure and extending to a second end slidably attached with the left leg supporting portion;

a fourth member with a first end selectably attachable at different longitudinal locations on the frame structure and extending to a second end slidably attached with the left leg supporting portion; and an adjustable right leg support linkage configured to fixably support the right leg supporting portion at the third range of angles with respect to the frame structure and comprising:

a fifth member pivotably attached at a first end with the frame structure and extending to a second end slidably attached with the right leg supporting portion; and a sixth member with a first end selectably attachable at different longitudinal locations on the frame structure and extending to a second end slidably attached with the right leg supporting portion.

2. The articulating bench of claim 1, wherein the second member is selectably attachable at different longitudinal locations on the frame structure by selectably engaging first teeth in a first serrated member, the fourth member is selectably attachable at different longitudinal locations on the frame structure by selectably engaging second teeth in a second serrated member, and the sixth member is selectably attachable at different longitudinal locations on the frame structure by selectably engaging third teeth in a third serrated member.

3. The articulating bench of claim 2, wherein the frame structure further comprises a back support frame structure supporting the adjustable back support linkage and pivotably attached with the central portion and a leg support frame structure supporting the adjustable left leg support linkage and the adjustable right leg support linkage and pivotably attached with the central bracket.

4. The articulating bench of claim 3, wherein the frame structure is constructed to fold-up about the central portion by the back support frame structure and the leg support frame structure both independently pivoting about the central portion from about zero degrees when the back support frame structure and the leg support frame structure are approximately horizontal, up to approximately 90 degrees when the back support frame structure and the leg support frame structure are approximately vertical.

* * * * *